US007070173B2

(12) United States Patent
Dow et al.

(10) Patent No.: US 7,070,173 B2
(45) Date of Patent: Jul. 4, 2006

(54) CARBURETOR AIR-FUEL MIXTURE ADJUSTMENT ASSEMBLY

(75) Inventors: Paul J. Dow, Cass City, MI (US); Hiroki Ogasawara, Shibata-Gun (JP); Tetsuya Takahashi, Shibata-Gun (JP); Toshimasa Takahashi, Shiroishi (JP); Giovanni Vimercati, Verano Brianza (IT)

(73) Assignee: Walbro Engine Management, L.L.C., Tucson, AZ (US)

( * ) Notice: Subject to any disclaimer, the term of this patent is extended or adjusted under 35 U.S.C. 154(b) by 0 days.

(21) Appl. No.: 11/171,037

(22) Filed: Jun. 30, 2005

(65) Prior Publication Data

US 2005/0236722 A1 Oct. 27, 2005

Related U.S. Application Data

(63) Continuation-in-part of application No. 10/955,869, filed on Sep. 30, 2004, now abandoned, which is a continuation-in-part of application No. 10/341,648, filed on Jan. 14, 2003, now abandoned.

(60) Provisional application No. 60/395,030, filed on Jul. 11, 2002.

(51) Int. Cl.
*F02M 3/08* (2006.01)
*F02M 9/08* (2006.01)

(52) U.S. Cl. ..... 261/44.6; 137/382; 261/44.8; 261/71; 261/DIG. 38; 261/DIG. 84

(58) Field of Classification Search ..... 261/44.1–44.9, 261/71, DIG. 38, DIG. 84; 137/382
See application file for complete search history.

(56) References Cited

U.S. PATENT DOCUMENTS 3,469,825 A * 9/1969 DuBois ..... 261/71
4,097,561 A * 6/1978 Seki et al. ..... 261/41.5
4,234,524 A * 11/1980 Arai ..... 261/41.5
4,271,093 A * 6/1981 Kobayashi ..... 261/34.1
4,271,095 A * 6/1981 Maeda ..... 261/41.5
4,283,353 A * 8/1981 Miller ..... 261/41.5

(Continued)

FOREIGN PATENT DOCUMENTS

JP 9-158783 * 6/1997
JP 9158783 6/1997

*Primary Examiner*—Richard L. Chiesa
(74) *Attorney, Agent, or Firm*—Reising, Ethington, Barnes, Kisselle, P.C.

(57) ABSTRACT

An apparatus for adjusting the air-fuel ratio of a fuel mixture to be supplied to an engine. The apparatus has a pair of needle valve bodies and a pair of receptacles formed in a main body of a carburetor for receiving the needle valve bodies. Each needle valve body has a needle and a head. The needles are axially movable relative to a respective needle orifice. The needles may be axially advanced and retracted by rotating the needle valve bodies within the receptacles to respectively decrease and increase the flow of the fuel mixture around the needles and through the orifices. To prevent tampering with the needle valve body setting, the head of the needle valve body has an unconventional shape requiring a specialized tool to rotatably adjust the needle valve body. To further prevent tampering, the head is recessed with the main body of the carburetor. A retainer is disposed in the main body of the carburetor and receives the needle valve bodies to facilitate maintaining alignment of the needle valve bodies relative to the receptacles. The retainer assures that a constant fuel calibration setting is maintained through the orifices by resisting displacement of the needles due to such factors as external forces applied to the head of the needle valve body or engine vibration.

65 Claims, 5 Drawing Sheets

U.S. PATENT DOCUMENTS 4,481,153 A * 11/1984 Kobayashi et al. ..... 261/44.2
4,568,499 A * 2/1986 Wood ..... 261/41.5
4,759,883 A * 7/1988 Woody et al. ..... 261/39.1
5,262,092 A * 11/1993 Reeder et al. ..... 261/35
5,322,645 A * 6/1994 Hammett et al. ..... 261/71
5,707,561 A 1/1998 Swanson ..... 261/71
5,709,822 A * 1/1998 Togashi ..... 261/44.2
5,753,148 A * 5/1998 King et al. ..... 261/71
5,776,379 A * 7/1998 Bowles ..... 261/71
5,961,896 A * 10/1999 Koizumi et al. ..... 261/67
6,003,845 A * 12/1999 Kus ..... 261/39.4
6,234,458 B1 * 5/2001 Gerhardy ..... 261/71
6,273,403 B1 * 8/2001 Kahlhamer ..... 261/44.3
6,302,384 B1 * 10/2001 Douyama ..... 261/71
6,402,124 B1 * 6/2002 Pattullo et al. ..... 261/71
6,769,670 B1 * 8/2004 Ohgane et al. ..... 261/44.6
6,945,520 B1 * 9/2005 Ohgane et al. ..... 261/44.6
2004/0007788 A1 * 1/2004 Vimercati ..... 261/71

* cited by examiner

CARBURETOR AIR-FUEL MIXTURE ADJUSTMENT ASSEMBLY

REFERENCE TO RELATED APPLICATION

This application is a Continuation-In-Part of U.S. patent application Ser. No. 10/955,869 filed Sep. 30, 2004, now abandoned which is a Continuation-In-Part of U.S. patent application Ser. No. 10/341,648, filed Jan. 14, 2003 and now abandoned, and each of which claims the benefit of U.S. Provisional Application No. 60/395,030, filed Jul. 11, 2002.

FIELD OF THE INVENTION

This invention relates generally to a carburetor fuel mixture adjustment assembly for adjusting the air-fuel ratio of a fuel mixture to be supplied to an engine.

BACKGROUND OF THE INVENTION

It is known for a carburetor air-fuel mixture adjustment assembly to include a needle valve body that is threaded into a bore in a carburetor main body. The bore in such an assembly intersects a fuel passage in the carburetor main body. The needle valve body has a shank with a tip, a head and an exteriorly threaded portion between them received in a complementary threaded portion of the bore. The tip of the valve body is positioned in axial alignment with an annular seat or orifice of the fuel passage and can be axially advanced and retracted by rotation of the needle valve body within the receptacle to adjust the air-fuel ratio of a fuel mixture. Axial advancement and retraction of the tip relative to the seat or orifice respectively decreases and increases the cross-sectional area of the flow path through the seat or orifice to decrease and increase the amount of fuel that can flow through the orifice. The needle valve body is rotated by using a tool such as a screwdriver to engage a screw head of the valve body that protrudes from the carburetor main body. In some such assemblies, to prevent inadvertent or uncommanded rotation of the valve body within the bore, a tamper-resistant cap is placed over the screw head and is secured to, or braced against an adjacent structure.

Fuel mixture adjustment assemblies of this type have "slop" or clearance between the respective threaded portions of the needle valve body and the bore which permits some axial and/or radial movement of the tip within the seat or orifice, such as when force is applied to the valve body head or while encountering engine vibration. This axial and/or radial movement can change the shape and size of the effective flow area around the tip enough to result in fuel flow rate changes of up to 20% from an optimum fuel flow rate as determined by the manufacturer. Fuel flow rate changes caused by needle "slop" can result in excessively rich or lean fuel mixtures that undesirably increase exhaust emissions and/or adversely affect engine performance. Therefore, it is desirable to reduce fuel flow fluctuations through the seat or orifice and the resulting affects on exhaust emissions and engine performance by limiting needle slop.

To assist in reducing fuel flow fluctuations, it is known to incorporate a spring between the protruding head of the needle valve body and the main body of the carburetor. This creates an axial preload between the mating threads of the needle valve body and the receptacle, thereby reducing the amount of radial and/or axial deflection of the needle valve body within the receptacle and inhibits unintended rotation of the needle valve body.

Another example of a stabilizing system for an air-fuel mixture adjustment needle valve is disclosed in Japanese Patent Application No. 7-346529 filed 12 Dec. 1995 (Japanese Laid-open Publication No. 9-158783 published 17 Jun. 1997). The Japanese Patent Application discloses a carburetor air-fuel mixture adjustment assembly as described above and including a pressure plate made of an elastic material and overlaid on an outer surface of the carburetor main body. The pressure plate includes an aperture that a threaded protruding portion of the needle valve body must be inserted through during assembly. The presence of the pressure plate limits movement of the needle valve body within the receptacle by holding the needle valve body in a centered position.

The carburetor air-fuel mixture adjustment assembly disclosed in this Japanese Patent Application also includes an annular sealing member coaxially disposed between the shank portion of the needle valve body and the receptacle such that the sealing member is compressed between the receptacle and the shank to prevent air from passing between the receptacle and valve body and leaking into the fuel passage. The sealing member is essentially an elongated tube of constant inner and outer diameter that must be forced over a shank portion of the needle valve body then forced into a section of the receptacle shaped to receive the sealing member during assembly. To produce an effective seal against air leakage into the carburetor, machining tolerances must be tight for inner and outer circumferential surfaces of the sealing member, an outer circumferential surface of the shank portion of the valve body, and an inner circumferential surface of the portion of the receptacle receiving the sealing member.

SUMMARY OF THE INVENTION

An apparatus for adjusting the air-fuel ratio of a carburetor with a needle valve body received in a receptacle of the carburetor body and having a seal between them preferably adjacent the tip and a retainer between them preferably adjacent the head of the needle valve body. The receptacle intersects a fuel passage in the carburetor main body. The needle valve body has a shank with a threaded portion between the tip and the head and is engaged with a complementary threaded portion in the receptacle so that rotation of the needle valve body axially advances and retracts the tip relative to a seat or orifice to respectively decrease and increase the flow area of the orifice through which fuel may pass. To prevent tampering with a factory setting of the needle valve body, preferably its head, may be received in a recess in the main body of the carburetor. Additionally, its head may have an unconventional, non-circular shape, thus requiring a specialized tool to rotatably adjust the needle valve body.

Preferably, a generally annular seal is concentrically disposed on the shank of the needle valve body adjacent the tip and is compressed between the receptacle and the shank. A generally annular retainer is preferably disposed concentrically on the shank adjacent the head of the needle valve body and is compressed between the receptacle and the shank. The retainer laterally biases the threaded portion of the needle valve body into engagement with an interiorly threaded portion of the receptacle and ensures alignment of the intermediate portion of the needle valve body with the receptacle, thus inhibiting radial or lateral movement of the needle valve body within the receptacle. The retainer also inhibits unintended rotation of the needle valve body. The retainer assures that a constant fuel calibration setting is maintained through the orifice by resisting axial and radial needle displacement and rotation due to such factors as external forces applied to the head of the needle valve body or engine vibration.

Another aspect of the invention provides an apparatus for adjusting the air-fuel ratio of a fuel mixture to be supplied to an engine having a main body with a retainer seat and a pair of fuel passages in communication with a pair of needle orifices. The main body has a pair of receptacles each having an interiorly threaded portion, with the receptacles communicating with a separate one of the fuel passages. A pair of needle valve bodies are received within a separate one of the receptacles, with each needle valve body including a tip, a head, an exteriorly threaded portion having a major diameter sized for complementary threaded engagement with the interiorly threaded portions of the receptacles, and an intermediate portion between the threaded portion and the head. A retainer has a pair of openings having diameters sized for a friction fit with a separate one of the intermediate portions to maintain a desired position of the needle valve bodies by inhibiting displacement of the tips relative to the needle orifices.

Objects, features and advantages of the invention include providing an assembly that maintains a fuel calibration setting in use by resisting inadvertent or unintended needle displacement between the needle valve body and the receptacle, permits use of a shorter length, reduced mass, and less expensive needle valve body, reduces the effects of vibration of the needle valve body, prevents inadvertent adjustment of the needle valve body, provides additional sealing between the needle valve body and receptacle to maintain the proper air-fuel ratio of the fuel mixture, reduces the complexity of the machining required to manufacture the needle valve body and the cost to manufacture the needle valve body, reduces offset or eccentricity between the needle valve body and the receptacle, and improves the ease and efficiency of manufacturing and assembly of a carburetor air-fuel mixture adjustment assembly.

BRIEF DESCRIPTION OF THE DRAWINGS

These and other objects, features and advantages of this invention will become apparent from the following detailed description of the preferred embodiments and best mode, appended claims, and accompanying drawings in which:

DETAILED DESCRIPTION

Figure 1:
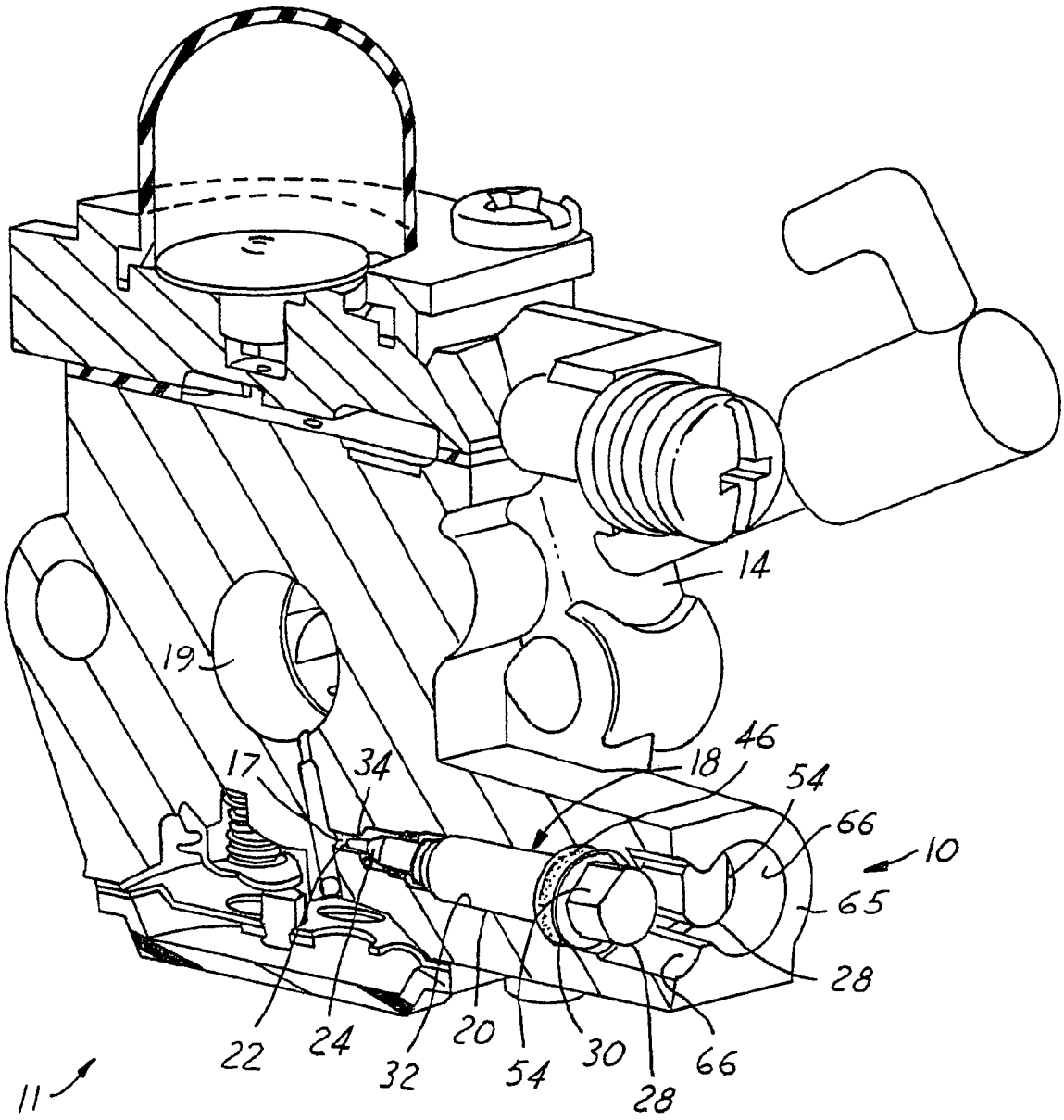
FIG. 1 is a perspective view of a carburetor including a fuel mixture adjustment assembly constructed according to a currently preferred embodiment of the invention.
Figure 2:
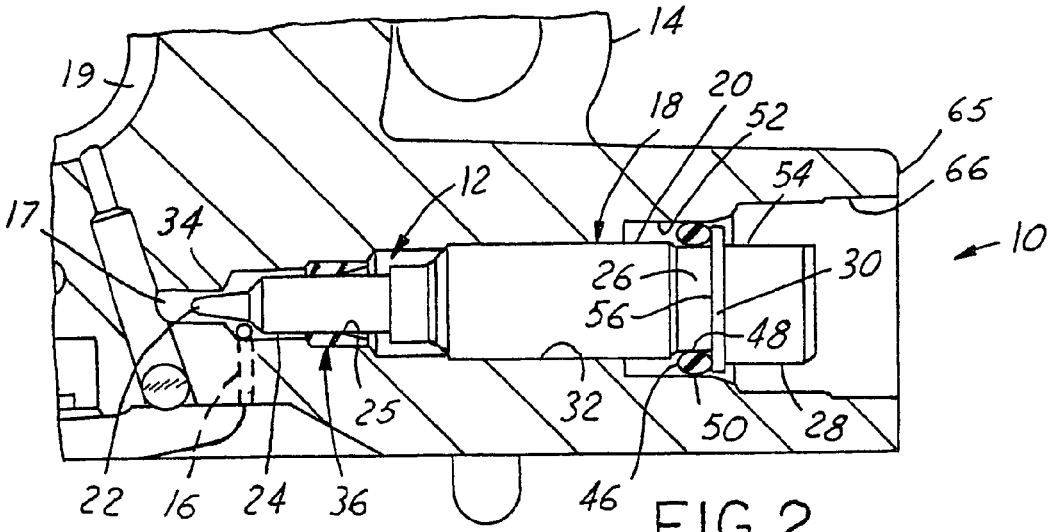
FIG. 2 is a fragmentary cross-sectional side view of the carburetor and assembly of FIG. 1.
Figure 3:
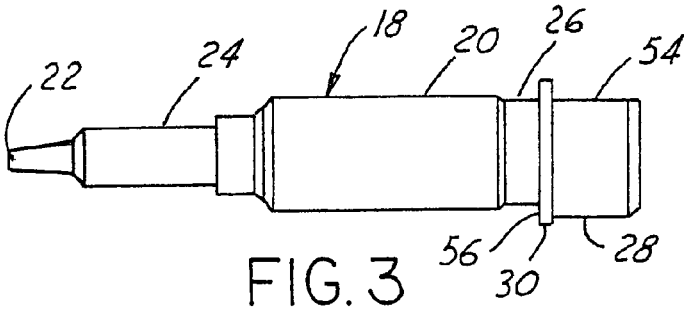
FIG. 3 is a side view of a needle valve body of the assembly of FIG. 1.
Figure 4:
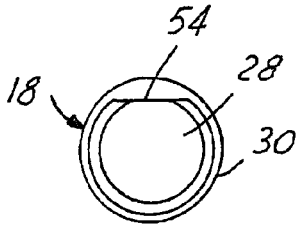
FIG. 4 is an end view of the needle valve body of FIG. 3.

FIGS. 1 and 2 illustrate an apparatus 10 embodying this invention for adjusting the air-fuel ratio of a fuel mixture supplied by a carburetor 11. The apparatus 10 includes a receptacle 12 formed in a main body 14 of a carburetor and a needle valve body 18 having a tip 22 concentrically supported within the receptacle 12 so that in operation, the tip 22 is disposed in an axially aligned orientation relative to a seat or orifice 34. The tip 22 can be axially advanced and retracted by rotating the needle valve body 18 within the receptacle 12. This axial movement of the tip 22 relative to the orifice 34 changes the effective flow area of the orifice 34 to adjust the air-fuel ratio of the fuel mixture.

Carburetor 11 may be a diaphragm carburetor, float bowl carburetor or other type of carburetor which utilizes a needle valve to adjust the air-fuel ratio of a fuel mixture supplied by the carburetor. The carburetor body 14 has a first fuel passage 16 and a second fuel passage 17 with the orifice 34 providing a flow path between the two passages 16, 17. The receptacle 12 intersects the first fuel passage 16 so that the fuel mixture flows around the tip 22 and through the orifice 34 and into the second fuel passage 17. The fuel mixture then flows from the second fuel passage 17 into an air and fuel mixing passage 19.

The carburetor body 14 has an extended boss 65 with a recess 66 opening into an end opposite the orifice 34. The recess 66 transitions into a retainer seat 52 that is preferably necked down from the recess 66. The receptacle 12 has an interiorly threaded portion 32 that is preferably necked down from the retainer seat 52. A seal seat 25 is constructed between the interiorly threaded portion 32 and the orifice 34.

The needle valve body 18 has a shank 24 with an integral tip 22, head 28 and threaded portion 20 between them which in assembly mates with complementary threads 32 of the receptacle 12. An intermediate portion 26 is integrally disposed between the head 28 and the threaded portion 20 and adjacent to a flange 30 of the head 28 defines a shoulder 56.

Figure 7:
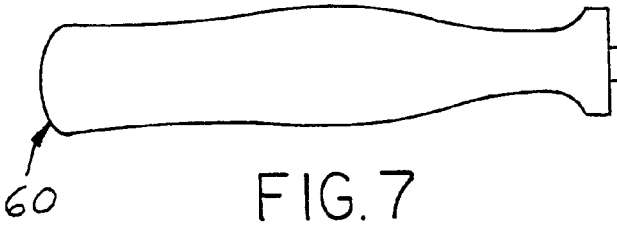
FIG. 7 is a partial cross-sectional side view of a specialized tool used for adjusting the needle valve body.
Figure 8:
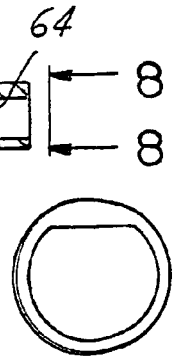
FIG. 8 is an end view of a head of the tool of FIG. 7 looking in the direction of arrows 8—8 of FIG. 7.

At least a portion of the head 28 of the needle valve body 18 is non-circular and is shown here as being generally D-shaped. The head 28 has a flat surface 54 extending axially from an end of the needle valve body 18 to the flange 30. The non-circular head 28 requires an unconventional tool 60 (not normally available to end users of the carburetor), as shown in FIGS. 7 and 8 to engage the head 28 and rotatably adjust the needle valve body 18 within the receptacle 12. The need for an unconventional specialized tool helps to ensure that the needle valve body 18 will not be adjusted by an end user from a factory setting required to comply with environmental standards and restrictions as may be governmentally mandated and/or to avoid adverse or deleterious engine operation.

As shown in FIGS. 7 and 8, the specialized tool 60 for engaging the generally D-shaped head 28 has an engagement socket 62 with an outside diameter sized to fit within the recess 66 and a receptacle portion 64 of the socket 62 having a generally D-shaped cavity that is complementary to and slightly larger than the head 28. This permits the socket 62 to fit over the head 28 for engaging and rotating the head 28 to adjust the needle valve body 18 to the desired setting.

To further inhibit adjustment of the needle valve body 18 from the preferred factory setting beyond the protection provided by the generally D-shape of the non-circular head 28, in assembly, the head 28 is preferably wholly received within the recess 66 of the main body 14. The recess 66 has an internal diameter and an axial depth sized to prevent readily available tools (such as a needle nose pliers) from engaging the head 28 of the needle valve body 18, thereby making it difficult for anyone not having the specialized tool 60 from tampering with or changing the factory setting of the needle valve body 18. By preventing tampering with the setting of the needle valve body 18 in this manner, no additional components may be required to prevent tampering. The prevention of tampering with the needle valve body 18 setting helps to ensure that the carburetor remains in compliance with the emissions standards that may be established by the EPA or other governmental organizations/agencies and/or the desired factory setting for proper operation of the engine.

Figure 5:
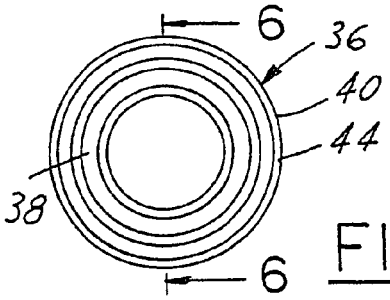
FIG. 5 is an end view of a sealing member of the assembly of FIG. 1.
Figure 6:
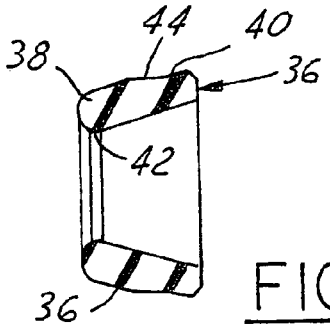
FIG. 6 is a cross-sectional side view of the sealing member of FIG. 5 taken along line 6—6 of FIG. 5.

An annular seal 36 is concentrically disposed on the shank 24 of the needle valve body 18. The seal 36, best shown in FIGS. 5 and 6, is compressed between the receptacle 12 and the shank 24 of the needle valve body 18. This stabilizes the tip 22 relative to the needle orifice 34 and prevents ambient air from passing between the needle valve body 18 and the receptacle 12 and entering the fuel passage 17. Therefore, the seal 36 helps to maintain the desired air-fuel ratio of the fuel mixture to both improve the running performance of the engine and decrease exhaust emissions.

The seal 36 has a generally frustroconical shape that includes integrally formed annular expansion and compression regions 38, 40. The expansion and compression regions 38, 40 are disposed adjacent respective axially opposite ends of the sealing member 36 and are configured to engage the needle valve body 18 and the receptacle 12, respectively. The expansion and compression regions 38, 40 are configured to provide a seal between the needle valve body 18 and the receptacle 12 without requiring close machining tolerances on interfacing surfaces of the needle valve body 18, the receptacle 12 or the seal 36. The expansion and compression regions 38, 40 are also configured to compensate for any misalignment or eccentricity that might exist between the shank 24 of the needle valve body 18 and the receptacle 12. Thus, an effective seal between the needle valve body 18 and the receptacle 12 is maintained by the expansion and compression regions 38, 40 even when the needle valve body 18 is not concentrically disposed within the receptacle 12.

As best shown in FIG. 6, the expansion region 38 of the seal 36 is disposed at an axial inner end of the seal 36. The expansion region 38 has a circumferential inner contact area 42 that is configured to expand slightly in a radially outward direction when installed over and around the shank 24 of the needle valve body 18.

The compression region 40 is disposed at an axial outer end of the seal 36 opposite the inner end. The compression region 40 has a circumferential outer contact area 44 that is configured to compress radially inward when seated in the receptacle 12. The outer contact area 44 is preferably greater than the inner contact area 42 of the expansion region 38. This ensures that the seal 36 stays in place when the shank 24 of the needle valve body 18 is backed out of the receptacle 12. The amount of interference between the shank 24 and the expansion region 38 of the seal 36 is calibrated to prevent excessive drag on the shank 24 of the needle valve body 18. The seal 36 is preferably formed of a thermoplastic polymer such as acetyl, but may be made of any suitable material such as, for example, rubber or metal.

An annular retainer 46, represented here as an o-ring, is concentrically disposed about the needle valve body 18 between the intermediate portion 26 and the retainer seat 52. Preferably, the o-ring retainer 46 is disposed around the intermediate portion 26 so that in assembly, an interference or friction fit between the retainer 46 and the intermediate portion 26 causes an inner circumferential contact area 48 to expand slightly. In assembly, the threaded portion 20 and the shoulder defined by the flange 30 of the head 28 act to maintain the retainer 46 on the intermediate portion 26 of the needle valve body 18.

The retainer 46 has an outer circumferential contact area 50 that is configured to compress slightly when the retainer 46 is seated within the retainer seat 52. Therefore, the retainer 46 is compressed radially between the intermediate portion 26 of the needle valve body 18 and the retainer seat 52. The retainer seat 52 preferably has a diameter that is larger than the interiorly threaded portion 32. The retainer 46, while in compression between the intermediate portion 26 of the needle valve body 18 and the retainer seat 52 of the receptacle 12, acts to bias the threaded portion 20 of the needle valve body 18 into frictional engagement with the threaded portion 32 of the receptacle 12. The frictional engagement of the retainer 46 and the mating threads 20, 32 inhibits misalignment of the needle valve body 18 within the receptacle 12, and thus, facilitates maintaining the desired fuel-air ratio and fuel mixture flow around the needle 22 and through the needle orifice 34. In addition, the frictional engagement between the retainer 46 and the mating threads 20, 32 inhibits the inadvertent rotation or adjustment of the needle valve body 18 within the receptacle 12 due to such factors as, for example, engine vibration. It should be recognized that the retainer 46 fosters a reduction in the mass of the needle valve body 18 as shown in a preferred embodiment by effectively reducing its length. Additionally, the embodiment shown does not require a spring to establish a preload between the needle valve body 18 and the receptacle 12.

Additionally, to provide additional sealing to prevent ambient air from leaking past the threads of the needle valve body 18 and into the fuel passage 17 which would thereby affect the desired air-fuel ratio of the fuel mixture, the retainer 46 establishes an interference or compression fit between the intermediate portion 26 of the needle valve body 18 and the retainer seat 52 of the receptacle 12. To accomplish this, the inner and outer circumferential contact areas 48, 50 have an interference or compression fit with the intermediate portion 26 and the retainer seat 52, respectively. The retainer 46 is preferably formed of a thermoplastic polymer such as acetyl, but may be made of any suitable material such as, for example, plastic polymers, elastomers, thermoset polymers, rubbers or metals.

Figure 9:
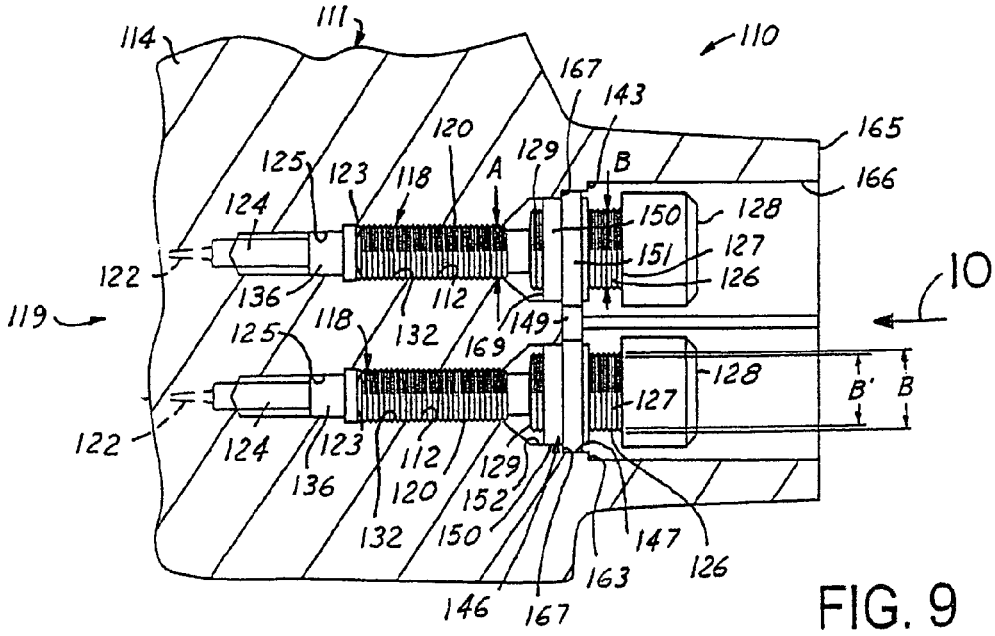
FIG. 9 is a fragmentary cross-sectional view of a carburetor including a fuel mixture adjustment assembly constructed according to another currently preferred embodiment of the invention.
Figure 10:
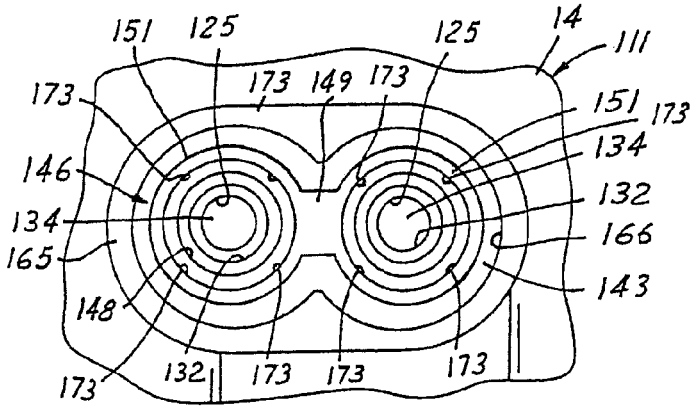
FIG. 10 is an enlarged end view looking generally in the direction of arrow 10 in FIG. 9 with a pair of needle valve bodies of FIG. 9 removed.
Figure 12:
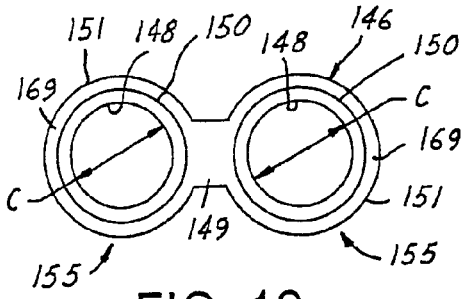
FIG. 12 is an enlarged plan view of the retainer of the fuel mixture adjustment assembly of FIG. 9 shown prior to inserting the needle valve bodies therein.

In FIGS. 9–13, another presently preferred embodiment of this invention is shown wherein similar reference numerals offset by 100 are used to identify similar features as in the previous embodiment. FIG. 9 illustrates an apparatus 110 embodying this invention for adjusting the air-fuel ratio of a fuel mixture supplied by a carburetor 111. The apparatus 110 includes a pair of receptacles 112 formed in a main body 114 of the carburetor 111 and a pair of needle valve bodies 118 having needles or tips 122 concentrically supported within the receptacles 112 so that in operation, the tips 122 are disposed in an axially aligned orientation relative to a pair of seats or orifices 134. The tips 122 can be axially advanced and retracted by rotating the needle valve bodies 118 within the receptacles 112. This axial movement of the tips 122 relative to the orifices 134 changes the effective flow area of the orifices 134 to adjust the air-fuel ratio of the fuel mixture. The needle valve bodies 118 preferably can be adjusted independently of one another, as desired.

Figure 11:
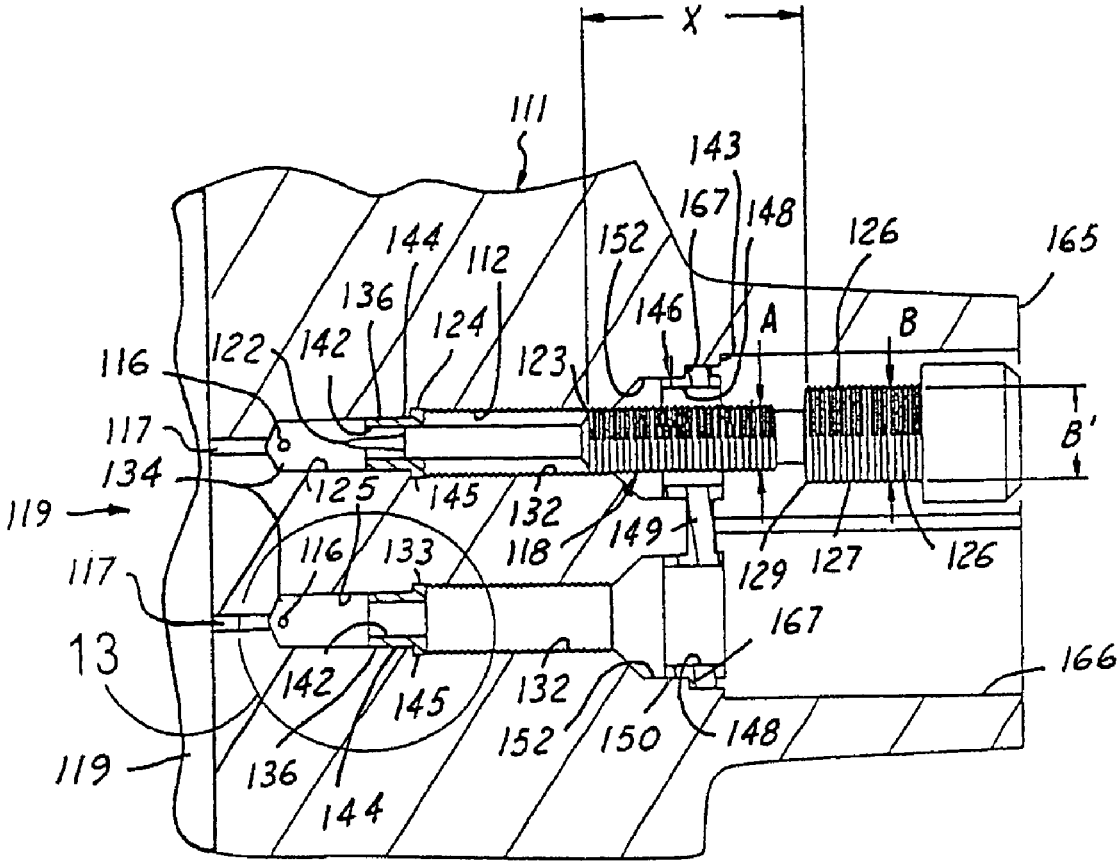
FIG. 11 is a fragmentary cross-sectional side view of one of the needle valve bodies being inserted in a receptacle of the carburetor of FIG. 9.

Referring to FIG. 11, the carburetor body 114 has a pair of first fuel passages 116 and a pair of second fuel passages 117 with the orifices 134 providing flow paths between the pairs of passages 116, 117. The receptacles 112 intersect the first fuel passages 116 so that the fuel mixture flows around the tips 122 and through the orifices 134 and into the second fuel passages 117. The fuel mixture then flows from the second fuel passages 117 into an air and fuel mixing passage 119.

Figure 13:
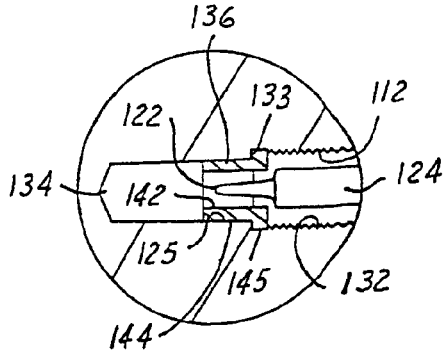
FIG. 13 is an enlarged partial cross-sectional view of the encircled area in FIG. 11.

The carburetor body 114 preferably has an extended boss 165 with a recess 166 extending to base or first shoulder 143. A first counterbore 147 extends axially inward from the first shoulder 143 to a second shoulder 167, and a second counter bore or retainer seat 152 extends axially inward from the second shoulder 167 toward the receptacles 112. The receptacles 112 have a pair of interiorly threaded portions 132 that are preferably reduced in diameter or necked down from the retainer seat 152. As best shown in FIG. 13, a pair of seal or guide bushing seats 125 are constructed between the interiorly threaded portions 132 and the orifices 134. The guide bushing seats 125 are preferably reduced in diameter from the threaded portions 132, thereby presenting seat shoulders 133 between the threaded portions 132 and the seats 125.

In this embodiment, the pair of needle valve bodies 118 preferably are generally identical in construction, and so only one needle valve body is described in detail hereafter, unless otherwise specified. The needle valve body 118 has a shank 124 extending generally axially from the tip 122, a head 128 and an exteriorly threaded portion 120 between the tip 122 and the head 128. The threaded portion 120 has an initial thread 123 generally adjacent the shank 124 and a major diameter (A) sized for complementary threaded engagement with one of the interiorly threaded portions 132 of the receptacles 112.

The needle valve body 118 has an intermediate portion 126 integrally disposed between the head 128 and the threaded portion 120. The intermediate portion 126 has a diameter greater than the major diameter (A) of the threaded portion 120, and desirably has an externally threaded portion 127 with a major diameter (B) and minor diameter (B'). The threaded portion 127 has an initial thread 129 generally adjacent the threaded portion 120, wherein the initial thread 129 is desirably located axially a predetermined distance (X) (FIG. 11) from the initial thread 123.

The head 128 of the needle valve body 118 is preferably wholly received within the recess 166 of the main body 114 and may be constructed as described in the previous embodiment, and thus, is not discussed in further detail hereafter.

A pair of annular seals or guide bushings 136 are concentrically disposed on the separate shanks 124 of the needle valve bodies 118. The guide bushings 136 are preferably compressed between the guide bushing seats 125 and the shanks 124 of the needle valve bodies 118. The guide bushings 136 assist in stabilizing the respective tips 122 in their desired radial relation relative to the needle orifices 134, and prevent ambient air from passing between the needle valve bodies 118 and the receptacles 112 and entering the fuel passages 117. The guide bushings 136 also inhibit fuel from passing between the needle valve bodies 118 and the receptacles 112 and exiting the fuel passages 117. Accordingly, the guide bushings 136 assist in maintaining the desired air-fuel ratio of the fuel mixture to both improve the running performance of the engine and decrease exhaust emissions.

The guide bushings 136 preferably are generally identical in construction, and so only one guide bushing is described in detail hereafter, unless otherwise specified. As shown in FIGS. 11 and 13, the guide bushing 136 preferably has an inner contact area or bore 142 sized for a friction fit on the shank 124 and a circumferential outer contact area 144 sized for a friction fit in the guide bushing seat 125. Therefore, the bore 142 is configured to expand slightly when disposed on the shank 124, while the outer contact area 144 is configured to compress radially inward when seated in the bushing seat 125. To ensure that the guide bushing 136 stays in place when the shank 124 of the needle valve body 118 is backed out of the receptacle 112, preferably the amount of interference fit or magnitude of friction force between the shank 124 and the bore 142 of the guide bushing 136 is calibrated to prevent excessive drag between the shank 124 and the bushing 136. Accordingly, the outer contact area 144 preferably has at least a slightly increased friction fit in the guide bushing seat 125 as compared to the friction fit of the inner contact area 142 on the shank 124.

To facilitate positioning the guide bushing 136 in its proper axial position within the guide bushing seat 125, and as best shown in FIG. 13, the guide bushing 136 preferably has a flange 145 extending radially outwardly from the outer contact area 144 for abutting engagement with the shoulder 133. As such, the extent to which the guide bushing 136 may be inserted within the seat 125 is limited by the engagement of the flange 145 with the shoulder 133. The guide bushing 136 is preferably formed of a thermoplastic polymer such as acetyl, but may be made of any suitable material such as, for example, metal.

A retainer 146 is preferably formed of a thermoplastic polymer such as acetyl, but may be made of any suitable material such as, for example, plastic polymers, elastomers, thermoset polymers, rubbers or metals. The retainer 146 has a pair of housings 155 (FIG. 12) that each have an annular inner contact area or opening 148 with diameters (C) sized for a friction fit on the intermediate portions 126 of the needle valve bodies 118. As such, the major diameters (B) on the intermediate portions 126 of the needle valve bodies 118 are desirably greater than the diameters (C), and preferably the minor diameters (B') are equal to or greater than the diameters (C) prior to engaging the intermediate portions 126 with the openings 148. The retainer 146 is constructed as a single piece of material such that the housings 155 are interconnected to one another by a medial connector 149. The retainer 146 has an outer contact area or surface 150 that is preferably sized for a friction fit within the retainer seat 152. The outer contact surface 150 preferably compresses slightly radially inward when the retainer 146 is seated within the retainer seat 152. Desirably, to facilitate locating the retainer 146 axially within the retainer seat 152, the retainer 146 has a flange 151 extending radially outwardly from the outer contact surface 150 presenting a surface 169 for abutting engagement with the second shoulder 167. Further, to facilitate maintaining the retainer 146 in the retainer seat 152, radially inwardly extending protrusions 173 are preferably formed in the first shoulder 143, such as in a staking, crimping or peening operation, for example. The protrusions 173 are thus formed from the first shoulder material being plastically deformed generally radially inwardly into frictional engagement with the flange 151 on the retainer 146.

In assembly, guide bushings 136 may either be pressed with a friction fit into their respective guide bushing seats 125 until the flanges 145 engage the shoulders 133, or the guide bushings 136 may be disposed on the shanks 124 of the needle valve bodies 118 for automatic installation of the guide bushings 136 upon insertion of the needle valve bodies 118 into their respective receptacles 112.

The retainer 146 is inserted within the recess 166 and pressed into the retainer seat 152 until the surface 169 of the flange 151 engages the second shoulder 167. Though the friction fit between the outer surface 150 of the retainer 146 and the retainer seat 152 assists in maintaining the retainer 146 in its intended position, preferably the protrusions 173 are formed in the first shoulder 143, such as through a staking operation, for example, to ensure that the retainer 146 is maintained in its desired position.

With the retainer 146 assembled in the retainer seat 152, the needle valve bodies 118 are inserted into their respective receptacles 112. As the needle valve bodies are being inserted into the receptacles 112, the initial threads 123 on the threaded portions 120 preferably engage the internally threaded portions 132 in the carburetor body 114 prior to the initial threads 129 of the intermediate portions 126 engaging the openings 148 within the retainer 146. This acts to avoid complications, such as cross threading, for example, between the threaded portions 120 of the needle valve bodies 146 and the threaded portions 132 in the carburetor body 114, which may otherwise result if the threaded portions 127 were allowed to engage the retainer 146 prior to the threaded portions 120 engaging the carburetor body 114. This desired result is due to the spacing (X) between the initial threads 123, 129.

Figure 11A:
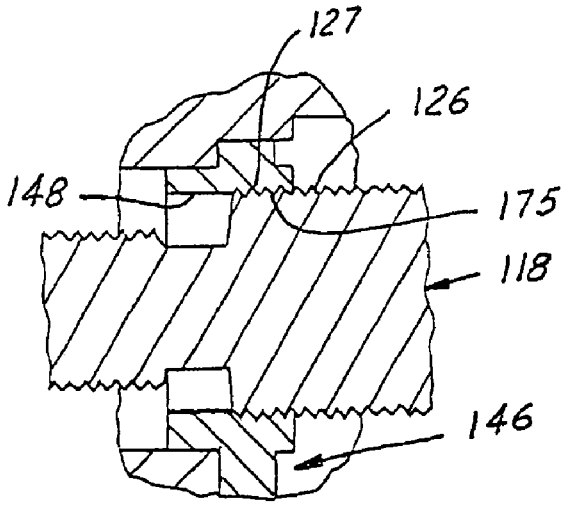
FIG. 11A is an enlarged fragmentary cross-sectional side view of one of the needle valve bodies initially engaging a retainer of the fuel mixture adjustment assembly of FIG. 9.

As the threaded intermediate portions 126 threadingly engage the openings 148 in the retainer 146 (FIG. 11A), the threaded portions 127 form self tapped threads 175 in the openings 148. This results from the major diameters (B) or minor diameters (B') being greater than the diameters (C).

The retainer 146, while in compression between the intermediate portions 126 of the needle valve bodies 118 and the retainer seats 152 of the receptacles 112, acts to inhibit misalignment of the needle valve bodies 118 within the receptacles 112, and thus, facilitates maintaining the desired fuel-air ratio and fuel mixture flow around the tips 122 and through the needle orifices 134. In addition, the friction force created by the engagement between the retainer 146 and the mating threaded portions 127 inhibits the inadvertent rotation or adjustment of the needle valve bodies 118 within the receptacles 112, which tends to result from such factors as engine vibration, for example. As such, the retainer 146 eliminates the need for other anti-rotation devices, such as a spring to establish a preload between the needle valve body 118 and the receptacle 112, for example. Further, the retainer 146 provides added sealing between the needle valve body 118 and the receptacle 112 in addition to the sealing provided by the guide bushing 136, thus, further preventing ambient air from leaking past the threaded portions 127 of the needle valve bodies 118 and into the fuel passages 117, as described in the previous embodiment.

In another implementation, as shown in FIGS. 14–18, a rotary throttle valve carburetor 200 may include a fuel adjustment assembly with one or more fuel adjustment valves that include an unconventional and preferably non-circular head. The rotary throttle valve carburetor 200 includes a body 202 defining a throttle valve chamber 204 in which a throttle valve 206 is rotatably and axially slidably received for movement between idle and wide open throttle positions. The throttle valve 206 includes a passage 208 that, when the throttle valve is moved toward its wide-open position, is increasingly registered with a fuel and air-mixing passage 210 formed in the carburetor body 202, preferably generally perpendicular to and intersecting with the throttle valve chamber 204. The main air supply is through the fuel and air mixing passage 210. Fuel is supplied from a fuel metering chamber 212 in the body 202 through a check valve 214, a fuel passage 216, and a main fuel nozzle 218 which has an orifice 220 open in the throttle valve chamber 204 and in communication with the fuel and air mixing passage 210. Fuel discharged from the orifice 220 is mixed with air flowing through the fuel and air mixing passage 210 and a fuel and air mixture is delivered to an engine to support operation of the engine. A rotary throttle valve carburetor is shown, for example, in U.S. Pat. No. 5,709,822 the disclosure of which is incorporated herein by reference in its entirety.

Figure 14:
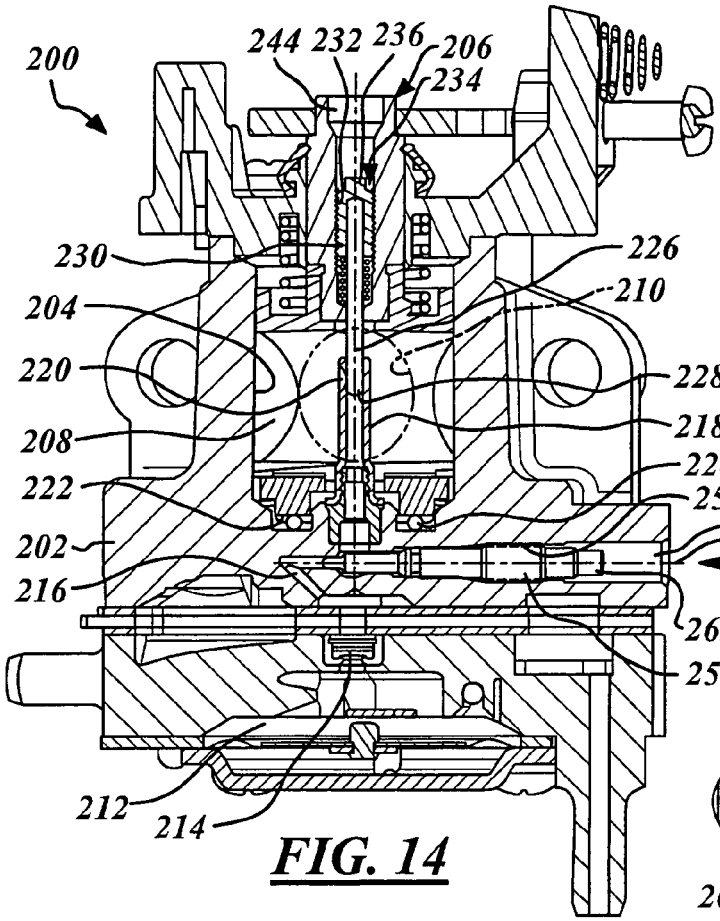
FIG. 14 is a sectional view of a rotary throttle valve carburetor including another embodiment of a fuel mixture adjustment assembly.

The throttle valve 206 interacts with a cam 222 that axially displaces the throttle valve 206 as the throttle valve is rotated. As shown in FIG. 14, the throttle valve 206 preferably carries a cam surface 222 that engages a follower 224 preferably disposed in a lower surface the throttle valve chamber 204 to provide the axial movement of the throttle valve 206. The throttle valve 206 preferably also carries a needle 226 that moves axially with the throttle valve 206 and relative to the main fuel nozzle 218 and its orifice 220. As best shown in FIG. 14, one end 228 of the needle 226 preferably is slidably received in an open end of the fuel nozzle 218. At least when the throttle valve 206 is in its idle position, the needle 226 restricts fluid flow through the orifice 220. As the throttle valve 206 is rotated away from its idle position, the needle 226 is axially displaced in a direction tending to withdraw the needle 226 from the fuel nozzle 218 and provide less restriction to fluid flow through the orifice 220.

The needle 226 preferably is adjustably carried by the throttle valve 206 to permit axial adjustment of the position of the needle 226 relative to the orifice 220 when the throttle valve 206 is in its idle position. This permits adjustment of the magnitude or degree of restriction of the orifice 220 when the throttle valve 206 is in its idle position and usually, for at least some range of movement of the throttle valve off idle wherein the needle 226 controls or provides some restriction to fluid flow through the orifice 220. To permit adjustment of the needle 226, it preferably includes a threaded portion 230 received in a complementarily threaded bore 232 in the throttle valve 206. The needle 226 preferably also includes a head 234 that is accessible at least for initial assembly and/or calibration to permit adjustment of the axial position of the needle 226. The head 234 preferably has a tool engaging portion 236 formed in an unconventional or uncommon shape so that commonly available tools are not suitable for use in moving the needle 226. This inhibits end user movement of the needle 226 which, for example, can affect the performance of and emissions from an engine with which the carburetor 200 is used. The threaded portion 230 may be part of the head 234 which may be formed integral with or, as shown in FIG. 14, may be part of a separate body connected to the needle 226.

Figure 16:
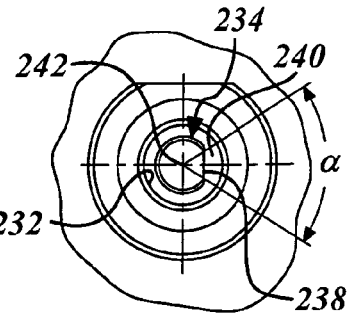
FIG. 16 is an enlarged fragmentary view of the encircled portion 16 in FIG. 15.
Figure 15:
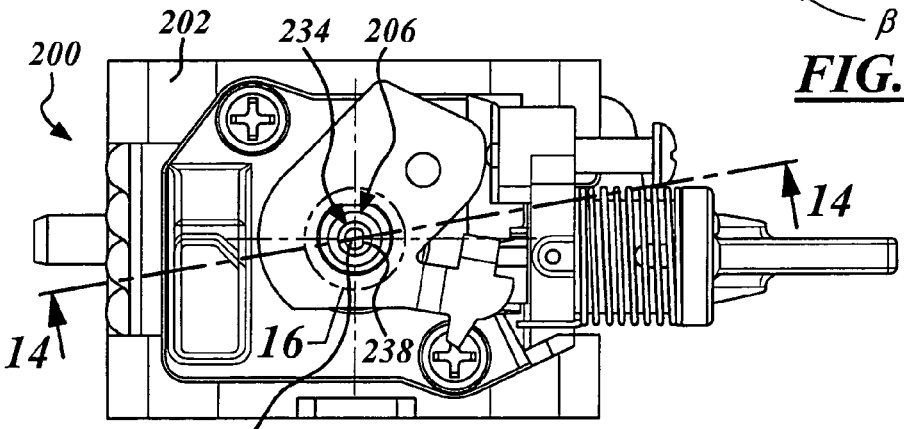
FIG. 15 is a plan view of the carburetor of FIG. 14.
Figure 18:
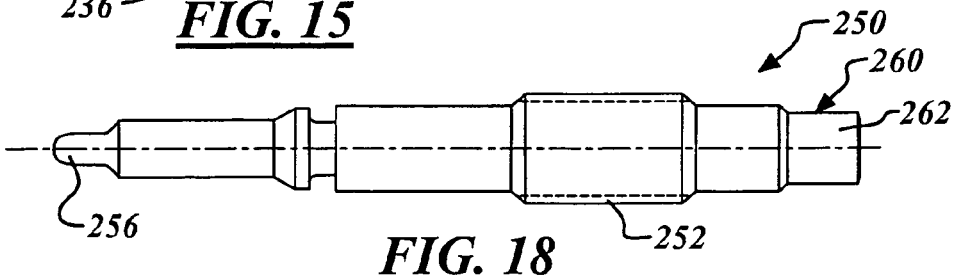
FIG. 18 is a side view of one embodiment of a fuel metering needle valve body having a non-circular head.

As best shown in FIGS. 14–16, the tool-engaging portion 236 of the head 234 in one presently preferred implementation is non-circular and is shown here as being generally D-shaped with a flat surface 238 extending axially from an end of the head 234 to a base 240. The flat surface 238 preferably spans an angle α measured from an axis 242 of the needle 226 of about 20 degrees to 180 degrees or so, and is generally shown in FIG. 16 as spanning an angle α of about 80 degrees. The remainder of the tool engaging portion 236 may form a partial circle, or be otherwise formed to receive a complementarily formed tool.

To further inhibit adjustment of the needle 226 from the preferred factory setting, the head 234 is preferably wholly received within a recess 244 of the throttle valve body 206. The recess 244 has an internal diameter and an axial depth sized to prevent readily available tools (such as a needle nose pliers) from engaging the head 234 of the needle 226. In this manner, the head 234 is relatively closely surrounded by the throttle valve body 206 which makes it difficult for anyone not having the specialized tool adapted for use with the needle valve 226 to tamper with or change its factory set position. By preventing tampering with the setting of the needle valve 226 in this manner, no additional components may be required to prevent tampering. Preventing changes to the needle valve position helps to ensure that the carburetor 200 remains in compliance with the emissions standards that may be established by the EPA or other governmental organizations/agencies and/or the desired factory setting for proper operation of the engine.

In addition to controlling the fuel flow at idle and off-idle positions of the throttle valve 206, it may be desirable to provide a valve that limits the maximum fuel flow rate in the carburetor to regulate high speed engine operation. To control the maximum fuel flow rate through the fuel passage 216 and hence, to the main fuel nozzle 218 and orifice 220, a high speed fuel metering needle valve 250 may be carried by the carburetor body 202 in communication with the fuel passage 216. The high speed needle valve 250 preferably includes a threaded shank portion 252 received in a threaded bore 254 of the carburetor body 202 to permit axial adjustment of the position of a tip 256 of the needle valve 250 relative to the fuel passage 216. In this implementation, the tip 256 provides a restriction to fuel flow through the fuel passage 216, such as through an orifice surrounding the tip, and thereby limits the maximum fuel flow rate through the fuel passage 216.

To facilitate turning the high speed needle valve 250 to move it axially relative to the carburetor body 202 and thereby adjust the magnitude or amount of the restriction to fuel flow provided by the valve body 250, it preferably includes a head 260 with a tool engaging portion 262. The head and/or its tool engaging portion 262 preferably is formed in an unconventional or uncommon shape so that commonly available tools are not suitable for use in moving the needle valve 250. This inhibits end user movement of the high speed needle valve 250 which, for example, can affect the performance of and emissions from an engine with which the carburetor 200 is used. The threaded portion 252 and/or the head 260 may be formed integral with or part of a separate body carried by and/or attached to the high speed needle valve 250.

Figure 17:
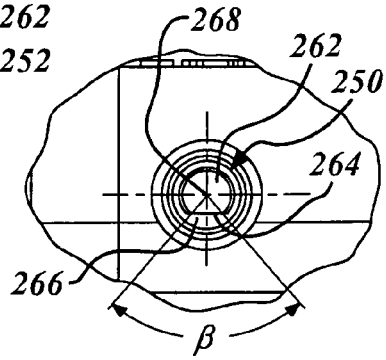
FIG. 17 is an enlarged fragmentary view taken in the direction indicated by the arrow 17 in FIG. 14.

As best shown in FIG. 17, the tool-engaging portion 262 of the head 260 in one presently preferred implementation is non-circular and is shown here as being generally D-shaped with a flat surface 264 extending axially from an end of the needle valve body 250 to a base 266. The flat surface 264 preferably spans an angle measured from an axis 268 of the needle of about 20 degrees to 180 degrees or so, and is generally shown in FIG. 17 as spanning an angle β of about 80 degrees. The remainder of the tool engaging portion 262 of the head 260 may form a partial circle, or be otherwise formed to receive a complementarily formed tool. The head 260 of the high speed needle valve 250 may be similar or identical in construction as the head 234 of the needle valve body 226 so that the same tool may be used to adjust the position of each. Of course, the heads 234, 260 could be different and may require different tools for each, if desired.

To further inhibit adjustment of the high-speed needle valve 250 from the preferred factory setting, the head 260 is preferably wholly received within a recess 270 of the carburetor body 202. The recess 270 has an internal diameter and an axial depth sized to prevent readily available tools (such as a needle nose pliers) from engaging the head 260 of the high speed needle valve 250. In this manner, the head 260 is relatively closely surrounded by the carburetor body 202 which makes it difficult for anyone not having the specialized tool adapted for use with the high speed needle valve 250 to tamper with or change its factory set position. By preventing tampering with the setting of the high speed needle valve 250 in this manner, no additional components may be required to prevent tampering. Preventing changes to the high speed needle valve position helps to ensure that the carburetor 200 remains in compliance with the emissions standards that may be established by the EPA or other governmental organizations/agencies and/or the desired factory setting for proper operation of the engine. The remainder of the high speed needle valve 250 may otherwise be constructed like the needle valve of the first embodiment, or otherwise as desired.

This description is intended to illustrate certain currently preferred embodiments and implementations of the invention rather than to limit the invention. Therefore, it uses descriptive rather than limiting words. Obviously, it is possible to modify this invention from what the description describes and shows. For example, it should be recognized that though the heads or tool engaging portions of the needle valves 18, 226, 250 are shown as being D-shaped, other unconventional configurations may be used to prevent standard tools available to retail consumers from being used to adjust the needle valve body. As another example, seals or retainers of different sizes, shapes, and arrangements may be used without departing from the spirit and scope of the invention as defined in the following claims. Within the scope of the claims, one may practice the invention other than as described.

What is claimed is:

1. An apparatus for adjusting the air-fuel ratio of a fuel mixture to be supplied to an engine, comprising:

a main body having a fuel passage, a needle orifice and a retainer seat;

a receptacle constructed in the main body having an interiorly threaded portion, the receptacle communicating with the fuel passage;

a needle valve body received within the receptacle and including a tip, an exteriorly threaded portion, a head, and an intermediate portion disposed between the threaded portion and the head, the exteriorly threaded portion being in complementary threaded engagement with the interiorly threaded portion, the tip being axially advanced and retracted relative to the needle orifice when the needle valve body is rotated within the receptacle to respectively decrease and increase the area between the tip and the needle orifice open to fuel flow; and a retainer disposed concentrically about the needle valve body between the intermediate portion and the retainer seat and compressed between the retainer seat and the intermediate portion biasing the threaded portion of the needle valve body into engagement with the interiorly threaded portion of the receptacle to maintain alignment of the tip relative to the needle orifice to maintain a desired position of the needle valve body by inhibiting tip displacement.

2. The apparatus of claim 1 wherein the main body has an extended boss with the head of the needle valve body recessed within the extended boss.

3. The apparatus of claim 2 wherein the head of the needle valve body has a non-circular shape requiring a specialized tool for engaging the head to rotatably adjust the needle valve body within the needle valve receptacle.

4. The apparatus of claim 3 wherein the head is generally D-shaped.

5. The apparatus of claim 1 wherein the retainer has an inner circumferential contact area that is configured to expand slightly when disposed around the intermediate portion of the needle valve body, and an outer circumferential contact area that is configured to compress slightly when seated within the retainer seat.

6. The apparatus of claim 1 wherein the retainer seat is adjacent the interiorly threaded portion.

7. The apparatus of claim 6 wherein the retainer seat has a diameter larger than the interiorly threaded portion.

8. An apparatus for adjusting the air-fuel ratio of a fuel mixture to be supplied to an engine, comprising:

a main body having a fuel passage, a needle orifice and a retainer seat;

a receptacle constructed in the main body and having an extended boss and an interiorly threaded portion, the receptacle communicating with the fuel passage;

a needle valve body received within the receptacle and including a tip, a head recessed within the extended boss of the main body to prevent tampering with the setting of the tip relative to the needle orifice, and an exteriorly threaded portion between the tip and the head, the exteriorly threaded portion being in threaded engagement with the interiorly threaded portion of the receptacle, the tip being axially advanceable and retractable relative to the needle orifice by rotating the needle valve body within the receptacle; and a retainer disposed concentrically about the needle valve body and compressed between the retainer seat and the needle valve body, axially biasing the threaded portion of the needle valve body into engagement with the interiorly threaded portion of the receptacle and maintaining alignment of the tip relative to the needle orifice to maintain the fuel calibration setting of the air-fuel ratio by resisting tip displacement.

9. The apparatus of claim 8 wherein the head of the needle valve body has a non-circular shape requiring a specialized tool for engaging the head to axially adjust the tip relative to the needle orifice.

10. The apparatus of claim 9 wherein the head is generally D-shaped.

11. The apparatus of claim 8 wherein the main body has an extended boss with the head of the needle valve body recessed within the extended boss to prevent tampering with the setting of the needle valve body.

12. The apparatus of claim 1 wherein the retainer is a ring of a resilient polymeric material compressed between the intermediate portion and the retainer seat to provide a seal between the needle valve body and the main body.

13. An apparatus for adjusting the air-fuel ratio of a fuel mixture to be supplied to an engine, comprising:

a main body having a fuel passage, a needle orifice and a retainer seat;

a receptacle constructed in the main body having an interiorly threaded portion, the receptacle communicating with the fuel passage;

a needle valve body received within the receptacle and including a tip, an exteriorly threaded portion, a head, and an intermediate portion disposed between the threaded portion and the head, the exteriorly threaded portion being in complementary threaded engagement with the interiorly threaded portion, the tip being axially advanced and retracted relative to the needle orifice when the needle valve body is rotated within the needle valve receptacle to respectively decrease and increase the area between the tip and the needle orifice open to fuel flow;

a retainer disposed concentrically about the needle valve body between the intermediate portion and the retainer seat and compressed between the retainer seat and the intermediate portion biasing the threaded portion of the needle valve body into engagement with the interiorly threaded portion of the receptacle to maintain alignment of the tip relative to the needle orifice to maintain a desired position of the needle valve body by inhibiting tip displacement; and an annular seal of a resilient polymeric material received and compressed between the main body and the needle valve body adjacent the tip of the needle valve body.

14. The apparatus of claim 1 wherein the retainer radially biases the threaded portion of the needle valve body into engagement with the interiorly threaded portion of the receptacle to maintain alignment of the tip relative to the needle orifice to maintain the fuel calibration setting of the air-fuel ratio by resisting tip displacement.

15. The apparatus of claim 13 wherein the head is generally D-shaped.

16. The apparatus of claim 13 wherein the seal has a generally frustoconical shape.

17. The apparatus of claim 13 wherein the needle valve body includes a shank between the tip and the threaded portion with the seal being disposed around said shank.

18. An apparatus for adjusting the air-fuel ratio of a fuel mixture to be supplied to an engine, comprising:

a main body having a retainer seat, a pair of needle orifices, at least one fuel passage in communication with the needle orifices, and a pair of receptacles each having an interiorly threaded portion, each receptacle communicating with a fuel passage;

a pair of needle valve bodies each received within a separate one of the receptacles, each needle valve body including a tip, a head, an exteriorly threaded portion having a major diameter sized for complementary threaded engagement with the interiorly threaded portions of the receptacles, and an intermediate portion between the threaded portion and the head, the tips being axially advanced and retracted relative to the needle orifices when the needle valve bodies are rotated within the needle valve receptacles to respectively decrease and increase the area between the tips and the needle orifices open to fuel flow; and a retainer having a pair of openings, each opening having a diameter sized for a friction fit with a separate one of the intermediate portions to maintain a desired position of the needle valve bodies by inhibiting displacement of the tips relative to the needle orifices.

19. The apparatus of claim 18 wherein the intermediate portions each have an exteriorly threaded portion for threaded engagement with the retainer.

20. The apparatus of claim 19 wherein the openings within the retainer have self tapped threads formed by the threaded portions of the intermediate portions.

21. The apparatus of claim 19 wherein each threaded portion of the intermediate portions has a major diameter, the major diameters of the intermediate portions being greater than the diameters of the openings in the retainer prior to engaging the intermediate portions with the openings.

22. The apparatus of claim 19 wherein the threaded portions of the needle valve bodies arranged for engagement with the receptacles are axially spaced from the respective threaded portions of the intermediate portions so that the threaded portions arranged for engagement with the receptacles engage the receptacles prior to the threaded portions of the intermediate portions engaging the retainer.

23. The apparatus of claim 19 wherein the threaded portions of the intermediate portions have a major diameter greater than the major diameter of the threaded portions for engagement with the receptacles.

24. The apparatus of claim 18 wherein the main body has an extended boss and the heads of the needle valve bodies are recessed within the extended boss.

25. The apparatus of claim 24 wherein the heads are non-circular about their circumference.

26. The apparatus of claim 18 wherein the retainers have a reduced diameter portion extending axially inwardly into a portion of the receptacles creating a friction fit between the reduced diameter portions and the receptacles.

27. The apparatus of claim 26 wherein the receptacles have at least one radially inwardly extending protrusion engaging the retainer to positively maintain the retainer in axially fixed positions within the receptacles.

28. The apparatus of claim 18 wherein the needle valve bodies each have a shank between the tips and the externally threaded portions, the shanks having a diameter less than the major diameters of the externally threaded portions and further comprising a pair of bushings with a separate bushing received for a friction fit on a separate one of the shanks to inhibit radial deflection of the tips relative to the needle orifices.

29. The apparatus of claim 28 wherein the receptacles each have a bushing seat and the bushings have outer diameters sized for a friction fit within the bushing seats.

30. The apparatus of claim 29 wherein the interiorly threaded portions of the receptacles have one diameter and the bushing seats have another diameter less than said one diameter to define shoulders between the interiorly threaded portions and the bushing seats, and the bushings have flanges extending radially outwardly from their outer diameters for abutment with the shoulders to limit the axial insertion of the bushings within the bushing seats.

31. The apparatus of claim 18 wherein the intermediate portion has a diameter greater than said major diameter.

32. The apparatus of claim 18 wherein the retainer is constructed as a single piece of material.

33. An apparatus for adjusting the air-fuel ratio of a fuel mixture to be supplied to an engine, comprising:

a main body having a retainer seat, a pair of needle orifices, a pair of fuel passages in communication with the needle orifices, and a pair of receptacles each communicating with a separate one of the fuel passages;

a pair of needle valve bodies each received within a separate one of the receptacles, each needle valve body including a tip, a head, and an intermediate portion between the tip and the head with each intermediate portion having an exteriorly threaded portion having a major diameter; and a retainer having a pair of openings, each opening having a diameter less than the major diameters of the intermediate portions so that the exteriorly threaded portions form self tapped threads with the openings of the retainers to maintain a desired position of the needle valve bodies and inhibit displacement of the tips relative to the needle orifices.

34. The apparatus of claim 30 wherein each receptacle has an interiorly threaded portion and the needle valve bodies each have an exteriorly threaded portion sized for complementary threaded engagement with the interiorly threaded portions of the receptacles to axially advance and retract the tips relative to the needle orifices when the needle valve bodies are rotated within the needle valve receptacles.

35. The apparatus of claim 34 wherein the threaded portions of the needle valve bodies arranged for engagement with the receptacles are axially spaced from the respective threaded portions of the intermediate portions so that the threaded portions arranged for engagement with the receptacles threadingly engage the receptacles prior to the threaded portions of the intermediate portions engaging the retainer.

36. The apparatus of claim 34 wherein the exteriorly threaded portions of the needle valve bodies have major diameters less than the diameters of the openings in the retainers.

37. The apparatus of claim 33 wherein the needle valve bodies each have a shank between the tips and the externally threaded portions, the shanks having a diameter less than the major diameters of the externally threaded portions and further comprising a pair of bushings with a separate bushing received for a friction fit on a separate one of the shanks to inhibit radial deflection of the tips relative to the needle orifices.

38. The apparatus of claim 37 wherein the receptacles each have a bushing seat and the bushings have outer diameters sized for a friction fit within the bushing seats.

39. The apparatus of claim 38 wherein the interiorly threaded portions of the receptacles have one diameter and the bushing seats have another diameter less than said one diameter to define shoulders between the interiorly threaded portions and the bushing seats, the bushings have flanges extending radially outwardly from their outer surfaces for abutment with the shoulders to limit the axial insertion of the bushings within the bushing seats.

40. The apparatus of claim 19 wherein the threaded portions of the intermediate portions have a minor diameter, the minor diameter being greater than the diameter of the openings in the retainers.

41. The apparatus of claim 33 wherein the retainer is constructed as a single piece of material.

42. An apparatus for adjusting the air-fuel ratio of a fuel mixture to be supplied to an engine, comprising:

a main body having a retainer seat, a pair of needle orifices, at least one fuel passage in communication with the needle orifices, and a pair of receptacles each having an interiorly threaded portion, each receptacle communicating with a fuel passage;

a pair of needle valve bodies each received within a separate one of the receptacles, each needle valve body including a tip, a head, an exteriorly threaded portion having a major diameter sized for complementary threaded engagement with the interiorly threaded portions of the receptacles, and an intermediate portion between the threaded portion and the head, the tips being axially advanced and retracted relative to the needle orifices when the needle valve bodies are rotated within the needle valve receptacles to respectively decrease and increase the area between the tips and the needle orifices open to fuel flow; and a retainer having a pair of housings connected to one another, each housing having an opening with a diameter sized for a friction fit with a separate one of the intermediate portions to maintain a desired position of the needle valve bodies by inhibiting displacement of the tips relative to the needle orifices.

43. The apparatus of claim 42 wherein the retainer is constructed as a single piece of material.

44. The apparatus of claim 42 wherein the intermediate portions each have an exteriorly threaded portion for threaded engagement with the housings.

45. The apparatus of claim 44 wherein each threaded portion of the intermediate portions has a major diameter, the major diameters of the intermediate portions being greater than the diameters of the openings in the retainer prior to engaging the intermediate portions with the openings.

46. The apparatus of claim 44 wherein the threaded portions of the needle valve bodies arranged for engagement with the receptacles are axially spaced from the respective threaded portions of the intermediate portions so that the threaded portions arranged for engagement with the receptacles threadingly engage the receptacles prior to the threaded portions of the intermediate portions engaging the housings.

47. An apparatus for adjusting the air-fuel ratio of a fuel mixture to be supplied to an engine, comprising:

a main body having a retainer seat, a pair of needle orifices, at least one fuel passage in communication with the needle orifices, a pair of receptacles each having an interiorly threaded portion, and a bushing seat between each interiorly threaded portion and orifice, each receptacle communicating with a fuel passage;

a pair of needle valve bodies each received within a separate one of the receptacles, each needle valve body including a tip, a head, an exteriorly threaded portion having a major diameter sized for complementary threaded engagement with the interiorly threaded portions of the receptacles, an intermediate portion between the threaded portion and the head, and a shank between the tips and the externally threaded portions, the tips being axially advanced and retracted relative to the needle orifices when the needle valve bodies are rotated within the needle valve receptacles to respectively decrease and increase the area between the tips and the needle orifices open to fuel flow;

a pair of guide bushings sized for receipt in the bushing seats, each guide bushing having a bore sized for a friction fit on a separate one of the shanks; and a retainer having a pair of housings connected to one another, each housing having an opening with a diameter sized for a friction fit with a separate one of the intermediate portions to maintain a desired position of the needle valve bodies by inhibiting displacement of the tips relative to the needle orifices.

48. The apparatus of claim 47 wherein the guide bushings each have an outer contact area sized for a friction fit in the bushing seats.

49. The apparatus of claim 47 wherein the intermediate portions each have an exteriorly threaded portion for threaded engagement with the housings.

50. The apparatus of claim 49 wherein each threaded portion of the intermediate portions has a major diameter, the major diameters of the intermediate portions being greater than the diameters of the openings in the retainer prior to engaging the intermediate portions with the openings.

51. The apparatus of claim 49 wherein the threaded portions of the needle valve bodies arranged for engagement with the receptacles are axially spaced from the respective threaded portions of the intermediate portions so that the threaded portions arranged for engagement with the receptacles threadingly engage the receptacles prior to the threaded portions of the intermediate portions engaging the housings.

52. The apparatus of claim 47 wherein the shanks have a diameter less than the major diameters of the externally threaded portions.

53. The apparatus of claim 47 wherein the openings within the retainer have self tapped threads formed by the intermediate portions.

54. A rotary throttle valve carburetor, comprising:

a body defining a fuel and air mixing passage, a throttle valve chamber communicating with the fuel and air mixing passage and a fuel flow path communicating a supply of fuel with the fuel and air mixing passage;

a throttle valve rotatably and axially movably received in the throttle valve chamber for movement between an idle position and a wide open position to control fuel and air flow in the fuel and air mixing passage; and a valve threadedly carried by the carburetor in communication with the fuel flow path to restrict fuel flow through at least a portion of the fuel flow path in at least one position of the throttle valve to control the flow rate of fuel from the carburetor when the throttle valve is in said at least one position, the valve including a tool engaging portion by which the valve may be rotated and axially moved by way of its threads and the tool engaging portion is non-circular and adapted for use with a specialized tool.

55. The rotary throttle valve carburetor of claim 54 wherein the valve is carried by the throttle valve for movement with the throttle valve.

56. The rotary throttle valve carburetor of claim 55 wherein the fluid flow path includes a fuel nozzle with an orifice through which fuel is discharged from the nozzle to the fuel and air mixing passage and said valve at least partially restricts the orifice when the throttle valve is in its idle position.

57. The rotary throttle valve carburetor of claim 54 wherein the valve is carried by the carburetor body and restricts the maximum fluid flow through at least a portion of the fuel flow path.

58. The rotary throttle valve carburetor of claim 54 wherein the tool engaging portion includes a flat surface and is generally D-shaped.

59. The rotary throttle valve carburetor of claim 58 wherein the valve has an axis and the flat surface spans an angle measured from the axis of between 20 degrees and 180 degrees.

60. The rotary throttle valve carburetor of claim 54 wherein the valve is adjustably carried by the throttle valve for movement with the throttle valve, and wherein the carburetor also comprises a second valve that is adjustably carried by the carburetor body to restrict the maximum fluid flow through at least a portion of the fuel flow path and both the valve carried by the throttle valve and the second valve include non-circular tool engaging portions by which the positions of each valve with respect to the fuel flow path may be adjusted.

61. The rotary throttle valve carburetor of claim 60 wherein the tool engaging portions of the valve carried by the throttle valve and the second valve are similar in shape so that the same tool may be used to adjust both valves.

62. The rotary throttle valve carburetor of claim 55 wherein the throttle valve includes a recess in which the tool engaging portion is disposed to limit access to the tool engaging portion.

63. The rotary throttle valve carburetor of claim 62 wherein the throttle valve surrounds the tool engaging portion.

64. The rotary throttle valve carburetor of claim 57 wherein the carburetor body includes a recess in which the tool engaging portion is disposed to limit access to the tool engaging portion.

65. The rotary throttle valve carburetor of claim 64 wherein the carburetor body surrounds the tool engaging portion.

* * * * *